United States Patent [19]

Bui-Hai

[11] Patent Number: 4,546,471

[45] Date of Patent: Oct. 8, 1985

[54] MULTIPLEXING DEVICE FOR GROUPING TWO FREQUENCY BANDS

[75] Inventor: Nhu Bui-Hai, Paris, France

[73] Assignee: Thomson CSF, Paris, France

[21] Appl. No.: 504,826

[22] Filed: Jun. 16, 1983

[30] Foreign Application Priority Data

Jun. 25, 1982 [FR] France ..... 82 11208

[51] Int. Cl.[4] ..... H01P 1/213

[52] U.S. Cl. ..... 370/123; 370/30; 370/38; 343/756; 333/21 A

[58] Field of Search ..... 370/30, 123, 24, 38; 343/756; 333/21 A, 126, 135

[56] References Cited

U.S. PATENT DOCUMENTS

| | | | |
|---|---|---|---|
| 3,441,878 | 4/1969 | Standley | 333/135 |
| 3,731,235 | 5/1973 | Ditullio et al. | 333/6 |
| 4,117,423 | 9/1978 | Rosen | 333/21 A |
| 4,410,866 | 10/1983 | Bui-Hai | 333/208 |

FOREIGN PATENT DOCUMENTS

| | | | |
|---|---|---|---|
| 8016920 | 2/1982 | European Pat. Off. | 333/135 |
| 2459045 | 4/1976 | Fed. Rep. of Germany | 333/21 A |

OTHER PUBLICATIONS

Harkless, E. T., "A Network for Combining Radio Systems at 4, 6 and 11 kmc", Bell Tel. S. Tech. Pub. Monograph 3341, Nov. 1959.

Shinji, M. et al., "Shaped-Beam Horn-Reflector Antenna for Domestic Communication Satellite", Electronics and Communications in Japan, vol. 57-B, No. 6, Jun. 1974.

*Primary Examiner*—Robert L. Griffin
*Assistant Examiner*—Timothy K. Greer
*Attorney, Agent, or Firm*—Cushman, Darby & Cushman

[57] ABSTRACT

A multiplexing device for a multiband antenna. It essentially comprises, in series from the coupling input to the antenna: a common guide permitting the passage of a high frequency band and a low frequency band, into which issue by means of two coupling holes staggered with respect to one another along the common guide, two orthogonal guides which constitute the inputs for the two orthogonal polarizations of the lower band; a junction; and a polarization duplexer for the higher band. The coupling holes contain resonators forming a short-circuit for the higher band frequencies. The common guide contains, viewed from the antenna coupling input, between the first and second coupling holes, a first filter which reflects towards the first coupling holes the waves in the lower band and having the polarization of the wave passing through the first hole and, between the second coupling hole and the junction, a second filter which reflects towards the second coupling hole the waves located in the lower band and having the polarization of the wave to pass through the second hole.

3 Claims, 4 Drawing Figures

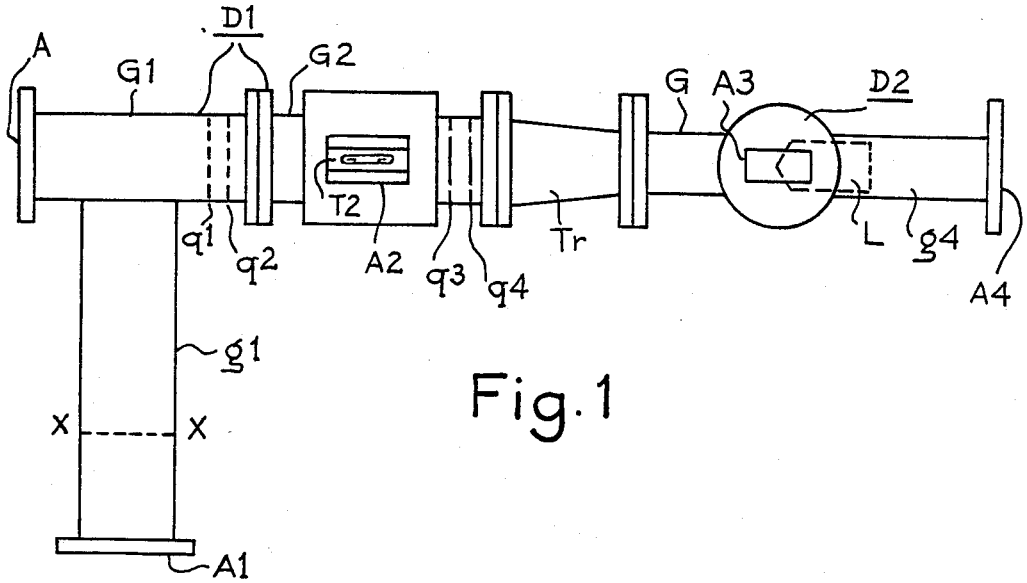
Fig.1
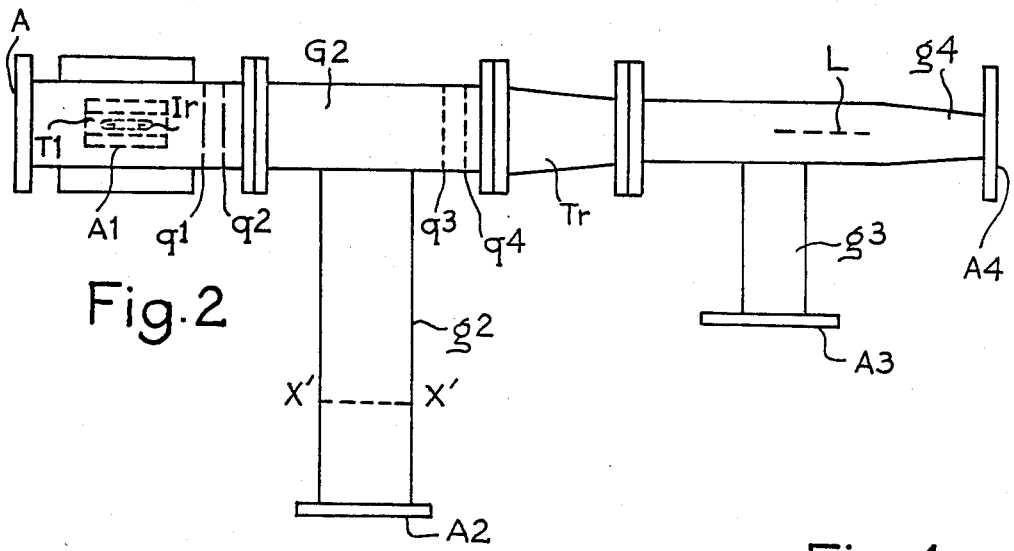
Fig.2
Fig.3
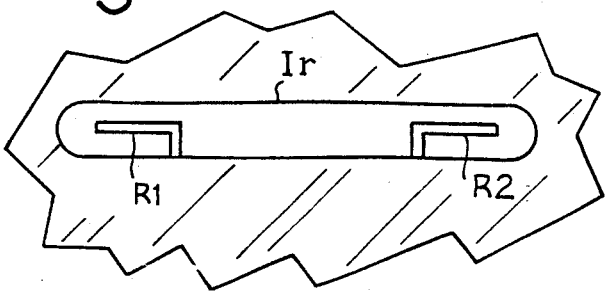
Fig.4
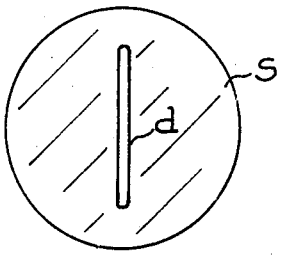

MULTIPLEXING DEVICE FOR GROUPING TWO FREQUENCY BANDS

BACKGROUND OF THE INVENTION

The present invention relates to a multiplexing device for multiplexing two frequency bands B1, B2, in which the frequencies of B1 are lower than the frequencies of B2 and comprising, starting from the antenna input or lead-in for coupling to an antenna, a first polarization duplexer with a common guide for passing bands B1 and B2 and a second polarization duplexer for band B2.

The present invention more particularly relates to a two-band multiplexer constituted by the aforementioned multiplexing device. It also relates to a multiplexer for multiplexing more than two frequency bands and which has a multiplexing device according to the invention.

Multiplexers make it possible to group several frequency bands on a same antenna and have been used for a considerable time for covering the needs of terrestrial and spatial radio beams. These multiplexers are of the two-band, three-band and higher types. The polarizations of the waves are either plane or circular.

The common feature of these known multiplexers is that their mechanical complexity leads to a high cost price. Apart from the duplexer of the lowest band, which generally has a relatively simple construction, the duplexers for the other bands are complicated. Thus, they require, for example, two directional couplers with total coupling in series and respectively relating to the two polarizations of the wave to be transmitted in the considered band, or as from four coupling holes distributed at 90° from one another about a common guide, they require a symmetrical structure formed from two pairs of guides, the guides of one pair arriving at two opposite holes and having to be joined together to form the input relative to one of the two polarizations. These known duplexers are also expensive, because they use expensive filters in the input guides of the different bands.

SUMMARY OF THE INVENTION

The object of the present invention is in particular to reduce the aforementioned disadvantages, whilst still providing the same technical performance levels. This is obtained by simplifying construction, whilst only using means which are individually known.

According to the present invention, there is provided a multiplexing device for multiplexing two frequency bands B1, B2, in which the frequencies of B1 are lower than the frequencies of B2, the device comprising in series an input to be coupled to an antenna, a first polarization duplexer comprising: a common guide for passing bands B1 and B2, said common guide having two successive guide sections, each having a single coupling hole in which is placed at least one resonator tuned to a frequency of band B2, the holes of the two sections being rotated with respect to one another by 90° about the common guide; two rectangular guides respectively leading to the two holes, a second polarization duplexer relating to band B2, said device further comprising first and second filters which, with respect to the antenna input, are respectively placed between the first and second of coupling holes, and between the second coupling hole and the second duplexer, each filter constituting a respectively short-circuit for the waves of band B1 having respectively a first and a second polarization, said first and second polarizations being orthogonal to one another.

BRIEF DESCRIPTION OF THE DRAWINGS

The invention is described in greater detail hereinafter relative to non-limiting embodiments and the attached drawings, which show:

FIGS. 1 and 2 side views of the same multiplexing device according to the invention.

FIGS. 3 and 4 detailed views relating to the multiplexing device of FIGS. 1 and 2.

DESCRIPTION OF THE PREFERRED EMBODIMENT

In the various drawings, each element is always designated by the same reference.

The example to be described hereinafter is a multiplexing device permitting the passage of four GHz bands (3.7–4.2 GHz) and six GHz bands (5.925–6.425 GHz), each of these two bands having two orthogonal polarizations, of either the plane or circular type.

FIG. 1 shows the multiplexing device when viewed from the side. FIG. 2 also shows the multiplexing device viewed from the side, but rotated by 90° with respect to FIG. 1.

FIGS. 1 and 2 show, in series starting from an input of lead-in A for coupling to an antenna, the first polarization duplexer D1 relating to the 4 GHz band, a circular guide-circular guide junction Tr and a second polarization duplexer D2 relating to the 6 GHz band.

The 4 GHz band duplexer D1 has a common guide G1–G2, whereof one of the ends constitutes input A and whose other input is joined to the largest of the two junction or transition openings Tr. Guide G1–G2 is a circular guide having an internal diameter of 54 mm and which consequently permits the passage of the 4 and 6 GHz bands.

By means of a coupling hole T1, to a section G1 of the common guide G1–G2 is coupled an input guide g1 for one of the two orthogonal polarizations of the 4 GHz band and which will be called the first polarization. At one of its ends, guide g1 is joined to a common guide section G1, whilst its second end forms input A1 of the first polarization.

In section G1, between coupling hole T1 and section G2, there is a quasi-optical filter q1–q2, whose function is to reflect towards the coupling hole T1, that part of the wave of the 4 GHz band having the first polarization. This quasi-optical filter will be described relative to FIG. 4.

Input guide g1 is a rectangular guide, whose small sides are perpendicular to the plane of FIG. 1. This guide has a transition area between input A1 and a straight line XX shown in the form of broken lines in FIG. 1. This transition zone makes it possible to pass from an opening of 58×29 mm on input A1 to an internal section of 58×14.5 mm between line XX and hole T1, in order to have a good adaptation or matching between the standard guide (58×29 mm) to be connected to input A1 and the common guide G1–G2. Also with the aim of improving adaptation, hole T1 is provided by a 39 mm long, 4 mm high iris Ir, a larger scale view being given in FIG. 3.

The large sides of iris Ir are parallel to the large sides of input guide g1. In said iris are arranged two linear resonators R1, R2 (cf. FIG. 3) whose resonant frequency is in the 6 GHz band and whose function is on the one hand to prevent the energy of the 6 GHz band from passing into the input guide, and on the other hand to permit the passage of the energy of the 4 GHz band. Each of the resonators R1, R2 comprises a metal strip shaped like an angle bracket and having a thickness of a tenth of a millimeter and a width of 1 mm. They are arranged in the plane of the iris and the 7 mm larger side of the angle bracket is parallel to the large sides of the iris.

As has been stated hereinbefore, a quasi-optical filter q1–q2 is arranged in the common guide section G1, between hole T1 and common guide section G2. This filter comprises two elements q1 and q2 which, as is shown in FIG. 4, are in each case formed by a substrate S on which is arranged a dipole d. Substrate S is made from polytetrafluoroethylene (also known under the registered trademark "Teflon") and dipole d is made from copper and is deposited on substrate S by printed circuit technology. The dipole d is 36 mm long and 1 mm wide. Elements q1 and q2 are arranged transversely in guide section G1 and dipole d is oriented, for each of the elements q1 and q2, so as to be parallel to the small sides of input guide g1, i.e. perpendicular to the plane of FIG. 1. Thus, the dipoles d of elements q1 and q2, whose resonant frequency is in the 4 GHz band, behave like short-circuits for that part of the wave of the 4 GHz band having the first polarization, i.e. for the wave relative to input A1 and whose polarization is perpendicular to the plane of FIG. 1.

Viewed from the antenna input A, the aforementioned assembly G1—g1 is followed by an identical assembly G2—g2, whereof the common guide section G2 is coupled to the extension of section G1 and whose input guide g2, relating to that part of the 4 GHz band having the second polarization, is directed perpendicular to the plane of FIG. 1. To elements q1, q2 and marking XX of assembly G1—g1, correspond in assembly G2—g2 elements q3, q4, which form a quasi-optical filter and markings X'X' indicating the location (between an input A2 of assembly G2—g2 and line X'X') of the transition zone of guide g2 corresponding to that of guide g1. It should be noted that as assembly G2—g2 is orthogonal to assembly G1—g1, the dipoles d (cf. FIG. 4) of the filter elements q3 and q4 are positioned parallel to the plane of FIG. 1 and consequently parallel to the small sides of input guide G1 thus, they behave as short-circuits for that part of the wave of the 4 GHz band having the second polarization and reflect it towards the coupling hole T2 of guide g2 on guide section G2.

It should be noted that the distance between coupling holes T1 and T2 must be at least of the same order of magnitude as the maximum wavelength in the 4 GHz band in order to ensure that, in this frequency band, the two polarizations of the wave do not interact.

The circular guide junction Tr makes it possible to pass from the 54 mm diameter of common guide G1–G2 (which permits the passage of the 4 and 6 GHz bands) to the 34 mm diameter of common guide G of duplexer D2 (which permits the passage of the 6 GHz band, but not the 4 GHz band).

Connected to its common guide G, the duplexer D2 of the 6 GHz band has two orthogonal guides relating respectively to the two polarizations of the wave in the 6 GHz band. These guides consist of an input guide g3, with an internal section of 34.85×15.8 mm, positioned perpendicularly to the common guide G and to the plane of FIG. 1, and an input guide g4 located in the extension of the common circular guide G and producing a transition or junction between said circular guide and a rectangular opening of dimensions 34.85×15.8 mm. In guide G, substantially between guides g3 and g4, duplexer D2 also has a short-circuit strip L, parallel to the plane of FIG. 1 and whose function is to short-circuit that part of the wave of the GHz band used for input A3, i.e. that having the polarization parallel to the plane of strip L. The ends of guides g3 and g4 opposite to guide G constitute the inputs A3 and A4 of duplexer D2 relating to the two plane polarizations of the wave in the 6 GHz band.

The multiplexing device used as an example in the above description has the following characteristics:

use frequency bands;
3.7–4.2 GHz and 5.925–6.425 GHz;
polarizations used: two per frequency band orthogonal plane polarization;
standing wave ratio at inputs A1, A2 4 GHz: equal to or below 1.12;
standing wave ratio at inputs A3, A4 (6 GHz): equal to or below 1.08;
decoupling between inputs A1 and A2 (4 GHz): equal to or above 40 dB;
decoupling between inputs A3 and A4 (6 GHz): equal to or above 35 dB;
losses in the 4 GHz band: equal to or below 0.25 dB;
losses in the 6 GHz band: equal to or below 0.3 dB.

The invention is not limited to the embodiment described. One having ordinary skill in the art will recognize that the features of the present invention can be easily adapted to produce multiplexers capable of multiplexing other bands, e.g. the 11 and 14 GHz or 18 and 20 GHz bands. In the same way a duplexer, like duplexer D1, designed for the 2 GHz (1.7–2.1 GHz) band, can be installed between the antenna and the duplexer D1, i.e. with one end of its common guide coupled to the antenna and the other end connected to input A of FIGS. 1 and 2 by a circular guide-circular guide junction.

It should also be noted that in these multiplexing devices, the common guides of the duplexers can have a square or rectangular section.

The multiplexing device according to the invention can operate in circular polarization, as has been stated hereinbefore. It is merely necessary to add thereto a polarizer connected between the antenna input A (FIGS. 1 and 2) and the antenna and operating in the 4 and 6 GHz bands.

The present invention is more particularly directed at multiplexers with frequency reuse, i.e. multiplexers such that the two orthogonal polarizations of the same wave are used as separate information carriers. The invention can be used in antennas of earth stations, both for space communications frequency bands and for terrestrial and tropospheric radio link bands.

What is claimed is:

1. A multiplexing device for multiplexing two frequency bands B1, B2, in which the frequencies of B1 are lower than the frequencies of B2, said device comprising:

an input adapted to be coupled to an antenna which receives said frequency bands B1 and B2, a first polarization duplexer connected to said input and including a common guide for passing bands B1 and B2, said common guide having two successive guide sections, each guide section having a single coupling hole in which is placed at least one resonator tuned to a frequency of band B2, the coupling holes of the two guide sections being rotated with respect to one another by 90° about the common guide and designated as first and second coupling holes, said first duplexer further including two rectangular guides, one leading to said first coupling hole and the other leading to said second coupling hole, each rectangular guide having two parallel short sides and two parallel long sides;

a second polarization duplexer relating to band B2 and connected to said first polarization duplexer; and first and second filters, said first filter being placed between said first coupling hole and said second coupling hole and constituting a short-circuit for the waves of band B1 which have a first polarization, and said second filter being placed between said second coupling hole and said second duplexer and constituting a short-circuit for the waves of band B1 which have a second polarization orthogonal to the first polarization.

2. A multiplexing device according to claim 1 wherein said first and second filters are quasi-optical filters having at least one dipole, whose resonant frequency is in band B1.

3. A multiplexing device according to claim 1, wherein the resonator placed in each coupling hole is a linear resonator formed from a first bar and a second bar each bar having a first end and a second end, the first end of said first bar is attached to said common guide so that said first bar is parallel to the short sides of said rectangular guide, said second end of said first bar is attached to the first end of said second bar so as to form an angle bracket whereby said second bar is parallel to the long sides of said rectangular guide and whereby the second end of said second bar is a free, unattached end.

* * * * *